US009328477B2

(12) United States Patent
Goodbourn et al.

(10) Patent No.: US 9,328,477 B2
(45) Date of Patent: May 3, 2016

(54) PILE GUIDE

(75) Inventors: Tom Goodbourn, Sturminster Newton (GB); James Mack, Swanage (GB)

(73) Assignee: IHC Sea Steel Ltd, Dorset (GB)

( * ) Notice: Subject to any disclaimer, the term of this patent is extended or adjusted under 35 U.S.C. 154(b) by 0 days.

(21) Appl. No.: 14/233,263

(22) PCT Filed: May 17, 2012

(86) PCT No.: PCT/GB2012/051108

§ 371 (c)(1), (2), (4) Date: Mar. 20, 2014

(87) PCT Pub. No.: WO2013/014416

PCT Pub. Date: Jan. 31, 2013

(65) Prior Publication Data

US 2014/0193209 A1 Jul. 10, 2014

(30) Foreign Application Priority Data

Jul. 25, 2011 (GB) ..... 1112732.1

(51) Int. Cl.
*E02D 13/04* (2006.01)

(52) U.S. Cl.
CPC ..... *E02D 13/04* (2013.01); *Y10T 29/49716* (2015.01)

(58) Field of Classification Search
CPC ..... E02D 13/04
See application file for complete search history.

(56) References Cited

U.S. PATENT DOCUMENTS

| | | | | |
|---|---|---|---|---|
| 5,568,997 | A * | 10/1996 | Raunisto | 405/232 |
| 5,609,380 | A * | 3/1997 | White | 294/104 |
| 6,994,493 | B2 * | 2/2006 | Jones | 405/232 |
| 7,972,083 | B2 * | 7/2011 | Jones | 405/232 |
| 2008/0310923 | A1 * | 12/2008 | Jinnings et al. | 405/232 |
| 2009/0129870 | A1 * | 5/2009 | Jones | 405/228 |

FOREIGN PATENT DOCUMENTS

| | | | |
|---|---|---|---|
| GB | 2473683 | A | 3/2011 |
| WO | WO99/11872 | A1 | 3/1999 |
| WO | WO01/02645 | A1 | 1/2001 |
| WO | WO03/074795 | A1 | 9/2003 |
| WO | WO2007/066078 | A1 | 6/2007 |

OTHER PUBLICATIONS

International Search Report and Written Opinion of PCT/GB2012/051108 mailed on Dec. 10, 2012, 11 pages.

* cited by examiner

*Primary Examiner* — Benjamin Fiorello
(74) *Attorney, Agent, or Firm* — Kilpatrick Townsend & Stockton LLP

(57) ABSTRACT

A pile guide for supporting a pile as it is driven into a substrate, comprises: a base frame; and a pile guide member (100) which is mounted on the base frame and defines a passageway with an inner peripheral surface (102) to which a plurality of elongate members (104) are attached. The plurality of elongate members (104) are configured to engage a pile and guide it in a predetermined direction through the passageway as it is driven into a substrate. At least one elongate member (104) and the inner peripheral surface (102) of the passageway have releasable inter-connecting profiles for releasably attaching the at least one elongate member (104) to the inner peripheral surface (102). The at least one elongate member (104) may readily be removed and replaced by a narrower/wider elongate member to accommodate piles of different diameter.

19 Claims, 4 Drawing Sheets

PILE GUIDE

TECHNICAL FIELD

This invention relates to pile driving, and more particularly, but not exclusively, to underwater pile driving, e.g. for stabbing piles directly into the seabed.

BACKGROUND ART

It is known to provide a guide for aligning a pile with the surface of a substrate into which the pile is to be driven and to provide stability for a piling hammer, see, for example, Sea Steel Limited's WO99/11872 (Fast Frame Pile Guide), WO01/02645 (Finned Frame/Follower pile guide) and WO03/074795 (Orientation Control Pile Guide).

The Fast Frame Pile Guide described in WO99/11872 comprises a base frame and a pile guide member for guiding a pile as it is driven into a substrate when the base frame is resting thereon. The pile guide member comprises two parts, each of which is pivotally mounted on the base frame by a support member. In this way, each of the two parts is moveable relative to the base frame between an operative position and an inoperative position by rotation about a respective pivot axis. The two parts are held in the operative positions by a latch mechanism, and counterweights are provided to urge the parts into their inoperative positions when the latch mechanism is released. With such a pile guide, it is possible to drive piles fully into a substrate without having to interrupt piling to move the pile guide away from the pile once it has been introduced into the substrate, simply by releasing the latch mechanism and allowing the parts of the pile guide to rotate into their inoperative positions to prevent the pile guide fouling the piling hammer.

The two parts of pile guide member of the Fast Frame Pile Guide define a hollow, substantially cylindrical portion for guiding a pile therethrough, when in the operative position. The substantially cylindrical portion has a plurality of rib-like spacers welded to its inner peripheral surface. Each rib-like spacer is elongate and aligned parallel to a central, longitudinal axis of the substantially cylindrical portion. The thickness of each rib-like spacer in a radial direction is adjusted (e.g. by grinding) to provide a snug, sliding fit with a pile driven through the pile guide member. In this way, the spacers are used to take up any dimensional tolerance or slack between the outer diameter of the pile and the inner diameter of the hollow cylindrical portion, albeit at additional cost. Not only does it take time to adjust each spacer, but also repeated welding and removal of spacers risks damage (e.g. heat fatigue) to the pile guide member. The same problem applies to spacers for pile guide members of other pile guides which define a substantially hollow cylindrical portion for guiding a pile therethrough, see for example the pile guides described in WO 03/074795 and WO 2007/066078, the entire contents of which are incorporated herein by reference.

The Fast Frame pile guide is extremely successful, but nevertheless the present applicant is striving to improve the original design. In particular, the present applicant has devised the present invention with a view to making it easier to transport/store the pile guide, e.g. by reducing weight and providing a structure which is more suitable for containerization.

STATEMENT OF INVENTION

In accordance with a first aspect of the present invention, there is provided a pile guide for supporting a pile as it is driven into a substrate, comprising: a base frame; and a pile guide member for guiding a pile as it is driven into a substrate when the base frame is resting thereon, the pile guide member comprising two parts each moveable between an operative position and an inoperative position, each part being pivotally mounted on the base frame by a support member for rotation about a respective first pivot axis; characterised in that each part of the pile guide member is pivotally coupled to its support member for rotation about a respective second pivot axis which is spaced from the respective first pivot axis.

In this way, each part of the pile guide member is moveable relative to the base frame about two respective pivot axes, enabling a greater range of movement than afforded by the single pivot axis that each part of the pile guide member has in the Fast Frame Pile Guide. Such additional movement may help to reduce the overall height of the pile guide when not in use, making it easier to transport or store or even maintain. In one form, at least one part may be moveable relative to the base frame from a substantially vertical orientation, when the pile guide member is in its operative position, to a substantially horizontal orientation following combined rotations through a first angle about the first pivot axis and a second angle about the second pivot axis. One of the first and second angles may be greater than the other. For example, the first angle may be about 60° and the second angle may be about 30°.

The respective first and second pivot axes of one part may be parallel, and the spacing therebetween may be non-adjustable. The respective first and second pivot axes of each part may be parallel. The respective first and second pivot axes of one part may be parallel to the respective first and second pivot axes of the other part. The first pivot axes of the two parts may be more widely spaced than the second pivot axes of the two parts.

At least one part may be configured to rotate under gravity about the respective second pivot axis into an intervening position relative to its support member, when the pile guide member is released from its operative position. For example, the centre mass of said at least one part may be located to one side of the respective second pivot axis. Said at least one part and its support member may be configured to rotate under gravity about the respective first pivot axis only when said at least one part reaches the intervening position relative to its support member. For example, the said at least one part and its support member may have a combined centre of mass which is configured to move from one lateral side of the respective first pivot axis to an opposing lateral side as the said at least one part rotates about the respective second pivot axis from its operative position to the intervening position. In this way, the at least one part moves into its inoperative position in two stages, with the first stage involving rotation only around the respective second pivot axis and the second stage involving subsequent rotation around the respective first pivot axis. The first stage may be used to shift the combined centre of mass to a position where it then drives the second stage. In this way, it may be possible to reduce or even avoid the use of dedicated counterweights to move the parts from the operative position to the inoperative position.

The pile guide may further comprise a mechanism for restoring the parts of the pile guide member to the operative position from the inoperative position. The mechanism may be configured to drive movement of the pile guide members from the inoperative position to the operative position only, i.e. the mechanism may be disengaged once the pile guide members are locked (e.g. with a latch) in their operative position so that the mechanism does not impede subsequent movement into the inoperative position when released. The mechanism may comprise a first variable length strut or piston pivotally coupled between the base frame and the support member of one part for rotating that support member about its first pivot axis. The mechanism may also comprise a second variable length strut or piston pivotally coupled between one part and its support member for rotating that one part about its second pivot axis. At least one variable length strut or piston may be hydraulically driven.

Each support member may be mounted on the base frame via a mounting arrangement configured to vary displacement and/or orientation of each respective first pivot axis relative to a substrate-engaging surface of the base frame. In this way, a levelling system is provided, making it possible to vary the orientation of the pile guide member in its operative position relative to the substrate-engaging surface of the base frame. This may be useful when piles need to be driven in a vertical orientation into a substrate which is inclined (i.e. non-horizontal). At least one mounting arrangement may comprise a pair of couplings spaced along the respective first pivot axis, with at least one of the pair of couplings being displaceable relative to the substrate-engaging surface of the base frame in a direction perpendicular thereto. At least one of the pair of couplings may be displaceable by a hydraulically driven device. Further details of the levelling system are disclosed in the present applicant's earlier application which was published as GB 2473683, the entire contents of which are hereby incorporated by reference.

In accordance with a second aspect of the present invention, there is provided a pile guide for supporting a pile as it is driven into a substrate, comprising: a base frame; and a pile guide member which is mounted on the base frame and defines a passageway with an inner peripheral surface to which a plurality of elongate members are attached, the plurality of elongate members being configured to engage a pile and guide it in a predetermined direction through the passageway as it is driven into a substrate, characterised in that at least one elongate member and the inner peripheral surface of the passageway have releasable interconnecting profiles for releasably attaching the at least one elongate member to the inner peripheral surface.

By providing the at least one elongate member and the inner peripheral surface of the passageway with releasable interconnecting profiles, the former may be readily attached and removed from the latter without the use of welding and thermal cutting equipment. This makes it possible to provide and fit different sizes of elongate members, depending upon the specifics of the piles to be driven into a substrate which may vary from one job to the next.

The interconnecting profiles may include a hook portion and a corresponding loop portion for receiving the hook portion. For example, the hook portion may be provided on the at least one elongate member and the corresponding loop portion may be provided on the inner peripheral surface of the passageway. The hook portion and corresponding loop portion may be orientated such that movement of a pile through the pile guide into a substrate beneath the base frame urges the hook portion towards the corresponding loop portion. The corresponding loop portion may be formed at least in part by a pair of support members with a channel therebetween for receiving the least one elongate member. The at least one elongate member may be a snug fit in the channel. In this way the pair of support members may help to resist lateral loads on the at least one elongate member.

The at least one elongate member and the inner peripheral surface of the passageway may further comprise interengaging profiles, spaced from the interconnecting profiles, which are configured to at least help support the at least one elongate member when attached to the inner peripheral surface. In this way, the interengaging and interconnecting profiles may together resist forces exited on the elongate member by pile guide moving through the pile guide as it is driven into a substrate beneath the base frame. The interengaging profiles may be configured to interengage, and possibly even interconnect, as the interconnecting profiles interconnect.

The pile guide may further comprise a lock mechanism for locking the at least one elongate member to the inner peripheral surface of the passageway once the interconnecting profiles are interconnected. The lock mechanism may comprise a bolt which in use couples part of one interconnecting profile to part of the other interconnecting profile to resist subsequent disconnection. The bolt may extend transversely through the at least one elongate member when locking it in position. The locking mechanism may be configured to avoid exposing the bolt to shear forces as the at least one elongate member slidingly engages a pile driven through the passageway into a substrate. If the locking mechanism is only used to prevent unintentional disengagement of the spacer from the inner peripheral surface of the passageway, it need not be over-engineered, e.g. a minimal bolt size may be used.

The at least one elongate member may be tapered at one end, or even at both ends. Such tapering may provide a tapered leading end which may assist with aligning a pile with the passageway as the pile is introduced into the pile guide member. Such tapering may also provide tapered leading and trailing ends which may help to avoid a pile snagging in the pile guide member.

The pile guide according to the second aspect of the invention may further comprise any of the features described in accordance with the first aspect of the invention.

In accordance with another aspect of the present invention, there is provided a method of adjusting a pile guide, comprising: providing a pile guide in accordance with the preceding aspect of the invention; removing the at least one elongate member by disconnecting the interconnecting profiles; providing at least one other elongate member with substantially the same interconnecting profile as the at least one elongate member, but which is configured to project a different amount into the passageway when interconnected to the corresponding profile on the inner peripheral surface of the passageway; and attaching the at least one other elongate member to the inner peripheral surface by interconnecting the respective profiles.

BRIEF DESCRIPTION OF THE DRAWINGS

An embodiment of the present invention will now be described, by way of example, and with reference to the accompanying figures, in which.

DESCRIPTION OF SPECIFIC EMBODIMENT

Figure 1:
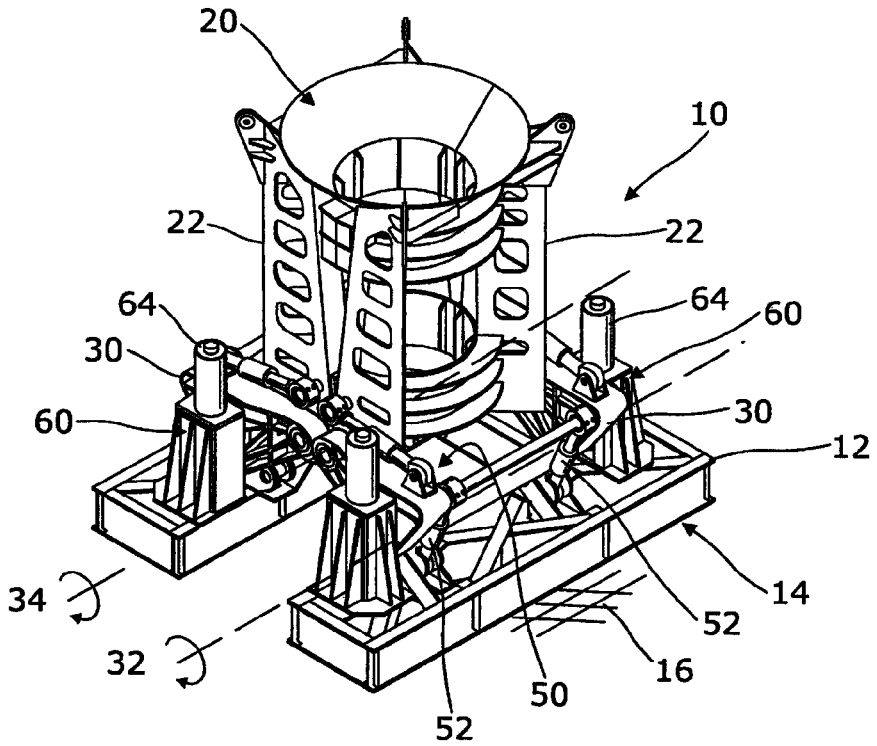
FIG. 1 illustrates a perspective view from front, one side and above of a pile guide embodying one aspect of the present invention, in its operative position.
Figure 2:
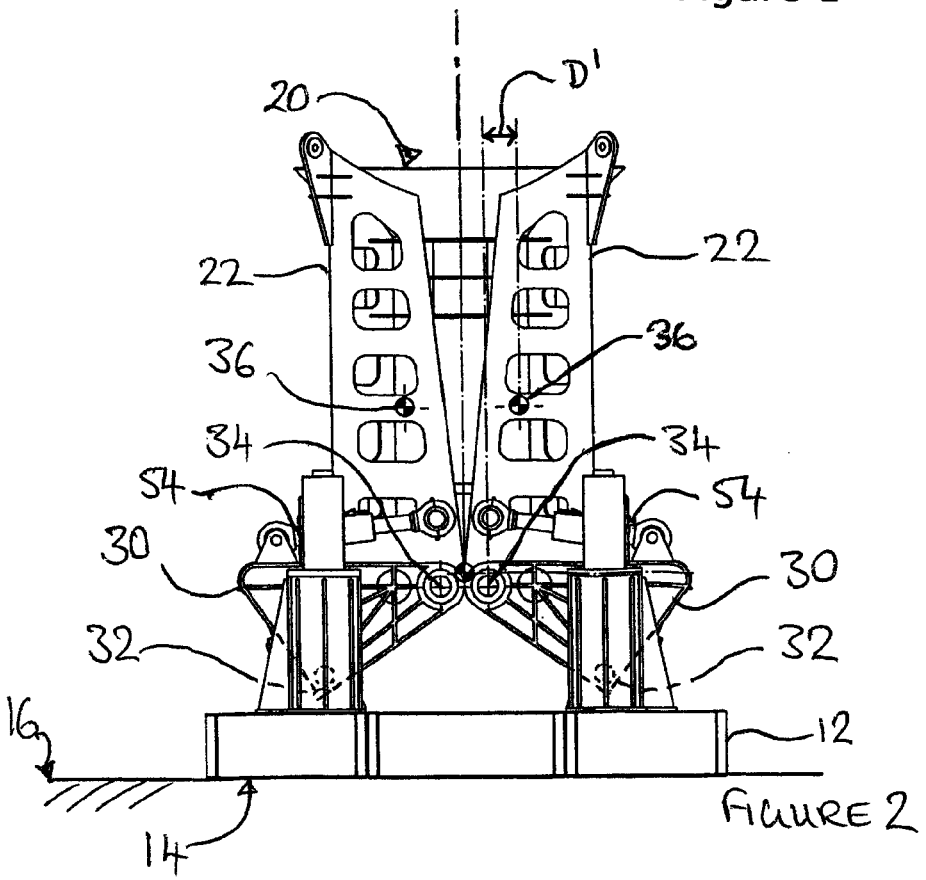
FIG. 2 illustrates a front elevation of the pile guide of FIG. 1 in its operative position.
Figure 4:
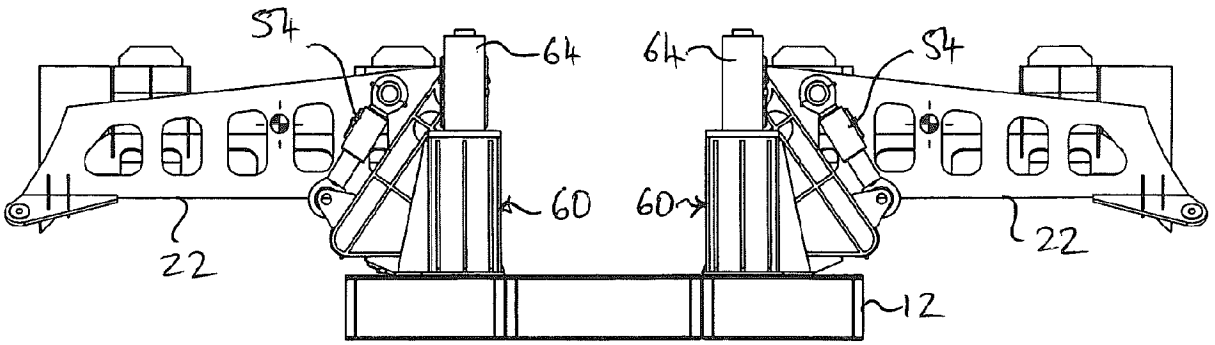
FIG. 4 illustrates a front elevation of the pile guide member of FIG. 1 in a second non-operative configuration.

FIG. 1 illustrates a pile guide 10 embodying the present invention and comprising a base frame 12 with a surface 14 for engaging a substrate 16. The pile guide 10 further comprises a pile guide member 20 for guiding a pile as it is driven into the substrate 16 when the base frame 12 is resting thereon. The pile guide member 20 comprises two parts 22 each movable between an operative position (where the two parts 22 together define a hollow cylinder for guiding a pile therethrough) and an inoperative position (where the two parts 22 are moved apart to avoid fowling a hammer—not shown—attached to one end of a pile as it is driven into the substrate 16). Each part 22 is pivotally mounted on the base frame 12 by a support member 30 for rotation about a respective first pivot axis 32. Furthermore, each part 22 is pivotally coupled to its support member 30 for rotation about a respective second pivot axis 34. The first and second pivot axes 32, 34 are parallel, with the first pivot axes of the two parts more widely spaced than the second pivot axes. In FIGS. 1, 2 and 4, the first pivot axis 32 of each part 22 is at least partially hidden by a mounting arrangement 60 which will be described in more detail below.

Figure 3:
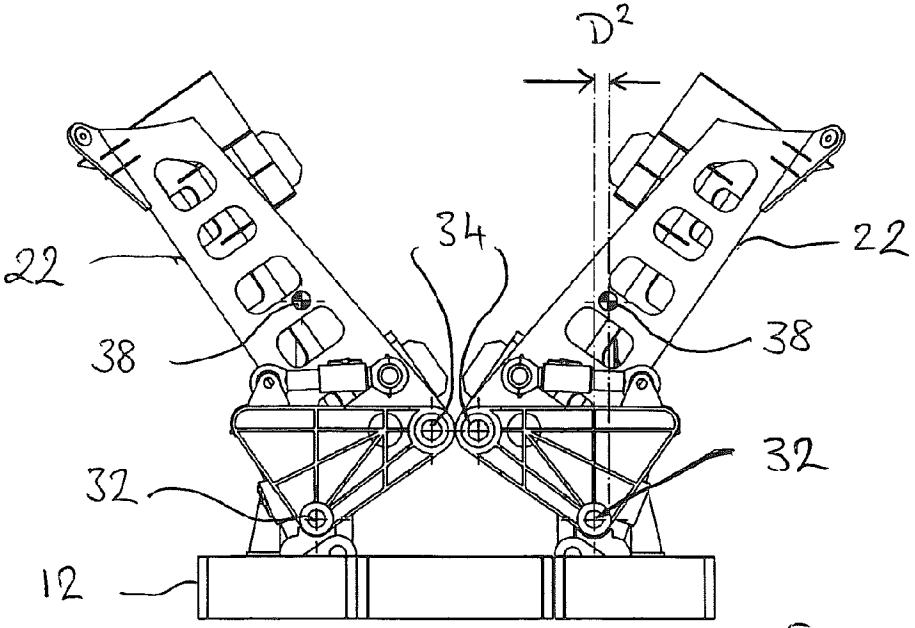
FIG. 3 illustrates a partially cut-away front elevation of the pile guide of FIG. 1 with pile guide members in a first non-operative configuration.

FIGS. 2 to 4 illustrate different positions of the parts 22 of the pile guide member 20, starting from the operative position. In FIG. 2, the parts 22 define a hollow cylinder with a longitudinal axis aligned substantially vertically. The parts 22 are held in the operative position by a locking mechanism such as a latch (not shown). Each part 22 is configured such that its centre of gravity 36 is spaced by distance $D^1$ to one lateral side of its second pivot axis 34. Thus, once the locking mechanism is released, each part 22 will rotate under gravity away from the other part about its respective second axis 34, until the parts 22 reach an intervening or first inoperative position illustrated in FIG. 3. As each part 22 rotates about its respective second axis 34, the centre of gravity 38 of the part 22 and its support member 30 combined shifts from one lateral side (inward side) of the first pivot axis 32, to the other lateral side (outward side) of the first pivot axis 32, until it is spaced a distance $D^2$ therefrom. This provides a new moment, driving rotation under gravity of the part 22 and its support member 30 about their respective first pivot axis 32 until the parts 22 reach the second inoperative position illustrated in FIG. 4. As shown in FIG. 4, the parts 22 are aligned substantially horizontally in a position where the pile guide 10 may be now easily transported, stored or maintained.

The pile guide 10 may further comprise a mechanism 50 for restoring each part 22 of the pile guide member 20 to the operative position from the second inoperative position shown in FIG. 4. The mechanism 50 comprises a first array of hydraulically driven pistons 52 which are pivotally coupled between the base frame 12 and one support member 30, for rotating that support member 30 about its respective first pivot axis 32. Thus, the first array of hydraulically driven pistons 52 is configured to drive the pile guide 10 from the configuration shown in FIG. 4 (i.e. second inoperative position) to the configuration shown in FIG. 3 (i.e. first inoperative position). The mechanism 50 may also comprise a second array of hydraulically driven pistons 54 which are pivotally coupled between one part 22 and its support member 30, for rotating the one part 22 about its second pivot axis 34. In this way, the second array of hydraulically driven pistons 54 is configured to drive the pile guide 10 from the configuration shown in FIG. 3 (i.e. first inoperative position) to the configuration shown in FIGS. 1 and 2 (i.e. operative position).

Each support member 30 is mounted on the base frame 12 via a mounting arrangement 60 configured to vary displacement and/or orientation of each respective first pivot axis relative to the substrate-engaging surface 14 of the base frame 12. Each mounting arrangement comprises a pair of couplings (not shown) spaced along each one of the first pivot axes 32. Each coupling is attached to a hydraulically driven piston 64 configured to displace its coupling in a direction substantially perpendicular to the substrate-engaging surface 14 of the base frame 12. In this way, either end of each of the first pivot axes 32 may be raised or lowered independently of the other. Thus, the orientation of the pile guide member 20 in the operative position may be varied relative to the substrate-engaging surface 14 of the base frame 12.

Figure 5:
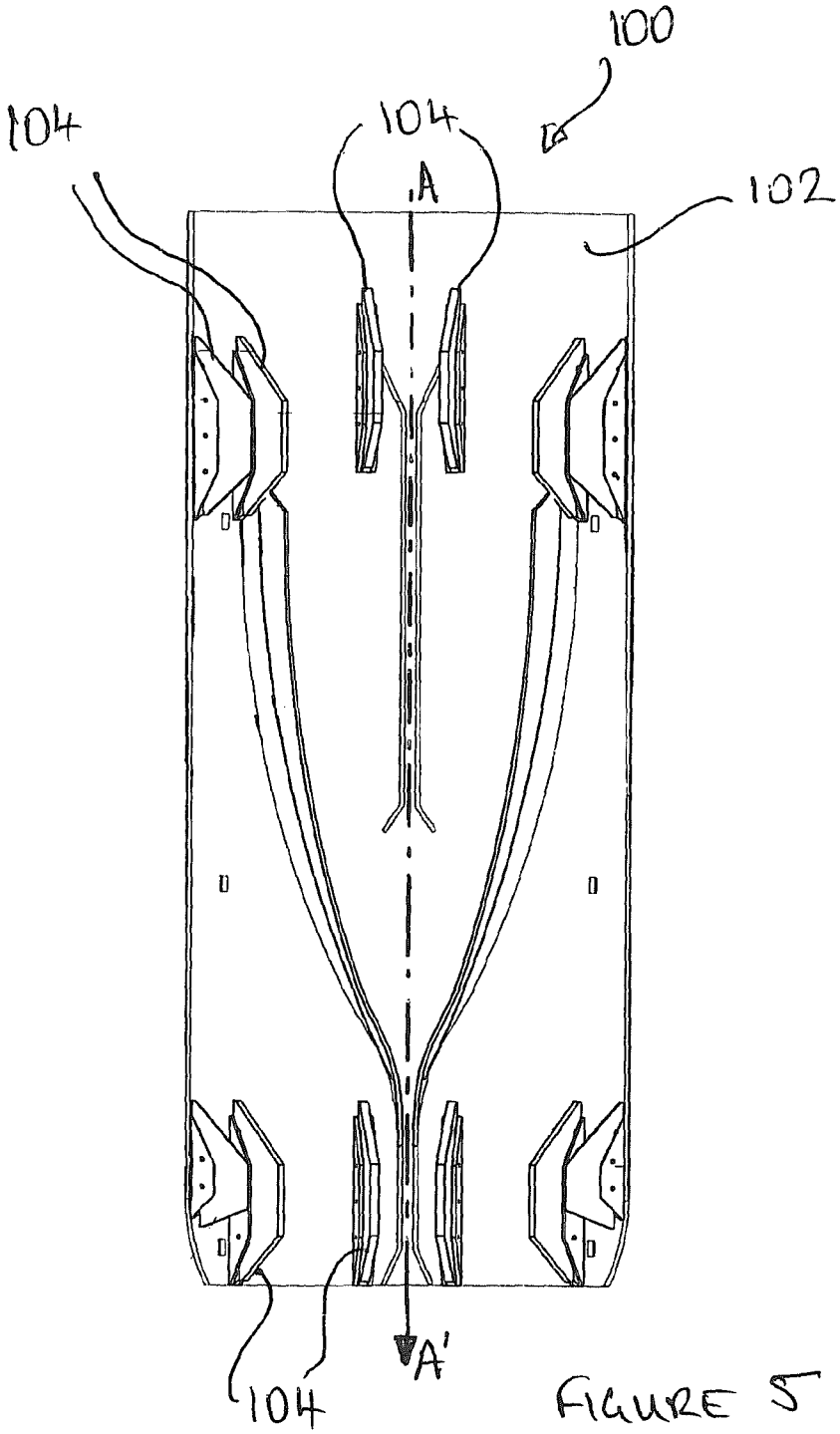
FIG. 5 illustrates part of a pile guide member embodying another aspect of the present invention.

FIG. 5 illustrates details of a pile guide member 100 embodying another aspect of the present invention. The pile guide member 100 includes a pair of helical guide plates of opposite senses of rotation which define a tapering channel for correcting any angular misorientation of a pile with a given profile for engaging part of the helical guide plates when passing through the pile guide member. Such a configuration is described at length in WO 03/074795 (the entire contents of which are incorporated hereby by reference), but will not be discussed further in the present application since the features of interest apply to other pile guides, including those described in connection with FIGS. 1-4 of the present application and in WO 99/11872 and WO 2007/066078.

The pile guide member 100 defines an elongate passageway with a substantially cylindrical inner peripheral surface 102 (only part of which is shown in FIG. 5). A plurality of elongate members 104 are attached to the inner peripheral surface 102, and are configured to engage a pile (not shown) and guide it in a predetermined direction AA' through the passageway as it is driven into a substrate. The plurality of elongate members 104 are circumferentially spaced around the inner peripheral surface 102, and each is aligned parallel to the predetermined direction. Each elongate member 104 and a corresponding portion of the inner peripheral surface 102 have releasable interconnecting profiles 120, 130 for releasably attaching the former to the latter. Details of the interconnecting profiles 120, 130 are described below.

Figure 6:
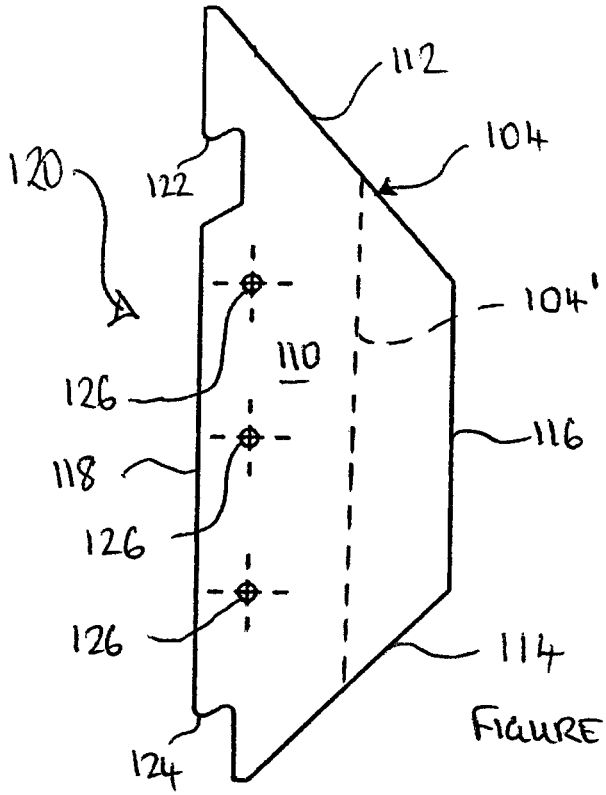
FIG. 6 illustrates detail of the pile guide of FIG. 5.

FIG. 6 illustrates one elongate member 104 which has a plate-like body 110 which is substantially trapezium-shaped. The body has tapered leading and trailing edges 112, 114 and an edge 116 therebetween which in use engages a pile being driven through the pile guide member 100. The remaining edge 118 defines interconnecting profile 120 which includes a first hook portion 122 and a second hook portion 124.

Figure 7:
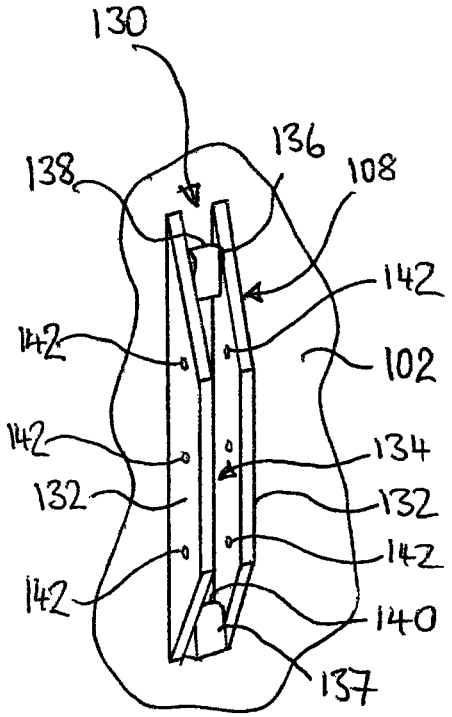
FIG. 7 illustrates more detail of the pile guide of FIG. 5.

FIG. 7 illustrates a corresponding portion 108 of the inner peripheral surface 102 which defines interconnecting profile 130 and comprises a pair of support members 132 with a channel 134 therebetween for receiving one elongate member 104. The support members 132 are welded to the pile guide member 100 and remain in situ. The channel 134 includes bridging members 136 and 137 which define (with support members 132) a first loop portion 138 and a second loop portion 140. The first loop portion 138 is configured to receive the first hook portion 122, and the second loop portion 140 as configured to receive the second hook portion 124, as the interconnecting profiles 120, 130 interconnect. Once the profiles 120, 130 are interconnected, apertures 126 in the elongate member 104 register with corresponding pairs of apertures 142 in the support members 132. The elongate member 104 may be locked in position using bolts (not shown) extending through the registered apertures 126, 142.

The pile guide member 100 may be provided with the elongate members 104 attached to the inner peripheral surface 102, as described above. However, the arrangement may not be fully compatible with the piles which need to be driven into a substrate. For example, the piles may have an outer diameter which is slightly too large to fit through the passageway due to the thickness of the elongate members 104 in a radial direction. If so, the elongate members 104 may be removed and replaced by slimmer elongate members 104' which have a profile highlighted by phantom lines in FIG. 6. In this way, the pile guide 100 may be readily modified to accommodate the piles without having to grind down the original elongate members 104.

The invention claimed is:

1. A pile guide for supporting a pile as it is driven into a substrate, comprising:

a base frame; and a pile guide member which is mounted on the base frame and defines a passageway with an inner peripheral surface to which a plurality of elongate members are attached, the plurality of elongate members being configured to engage a pile and guide it in a predetermined direction through the passageway as it is driven into a substrate, wherein at least one elongate member and the inner peripheral surface of the passageway have releasable inter-connecting profiles for releasably attaching the at least one elongate member to the inner peripheral surface, with the interconnecting profiles including a hook portion and a corresponding loop portion for receiving the hook portion, and with the hook portion and corresponding loop portion orientated such that movement of a pile through the passageway into a substrate beneath the base frame urges the hook portion to remain interconnected with the corresponding loop portion.

2. A pile guide according to claim 1, in which the corresponding loop portion is formed in part by a pair of support members defining a channel therebetween for receiving the at least one elongate member.

3. A pile guide according to claim 1, in which the at least one elongate member and the peripheral surface of the passageway further comprise interengaging profiles, spaced from the interconnecting profiles, which are configured to support the at least one elongate member when attached to the inner peripheral surface of the passageway.

4. A pile guide according to claim 1, further comprising a releasable lock mechanism for locking the at least one elongate member to the inner peripheral surface of the passageway once the interconnecting profiles are interconnected.

5. A pile guide according to claim 4, in which the releasable locking mechanism comprises a bolt which in use extends transversely through the at least one elongate member.

6. A method of adjusting a pile guide, comprising:

providing a pile guide comprising: a base frame; and a pile guide member which is mounted on the base frame and defines a passageway with an inner peripheral surface to which a plurality of elongate members are attached, the plurality of elongate members being configured to engage a pile and guide it in a predetermined direction through the passageway as it is driven into a substrate, with at least one elongate member and the inner peripheral surface of the passageway having releasable interconnecting profiles for releasably attaching the at least one elongate member to the inner peripheral surface, with the interconnecting profiles including a hook portion and a corresponding loop portion for receiving the hook portion, and a with the hook portion and corresponding loop portion orientated such that movement of a pile through the passageway into a substrate beneath the base frame urges the hook portion to remain interconnected with the corresponding loop portion;

removing the at least one elongate member by disconnecting the interconnecting profiles;

providing at least one other elongate member with substantially the same interconnecting profile as the at least one elongate member, but which is configured to project a different amount into the passageway when interconnected to the corresponding profile on the inner peripheral surface of the passageway; and attaching the at least one other elongate member to the inner peripheral surface by interconnecting their respective profiles.

7. A pile guide for supporting a pile as it is driven into a substrate, comprising:

a base frame; and a pile guide member for guiding a pile as it is driven into a substrate when the base frame is resting thereon, the pile guide member comprising two parts each moveable between an operative position and an inoperative position, each part being pivotally mounted on the base frame by a support member for rotation about a respective first pivot axis;

wherein each part of the pile guide member is pivotally coupled to its support member for rotation about a respective second pivot axis which is spaced from the respective first pivot axis.

8. A pile guide according to claim 7, in which at least one part is moveable relative to the base frame from a substantially vertical orientation, when the pile guide member is in its operative position, to a substantially horizontal orientation following combined rotations through a first angle about the first pivot axis and a second angle about the second pivot axis.

9. A pile guide according to claim 7, in which at least one part is configured to rotate under gravity about the respective second pivot axis into an intervening position relative to its support member, when the pile guide member is released from its operative position.

10. A pile guide according to claim 9, in which said at least one part and its support member are configured to rotate under gravity about the respective first pivot axis only when said at least one part reaches the intervening position relative to its support member.

11. A pile guide according to claim 10, in which said at least one part and its support member have a combined centre of mass which is configured to move from one lateral side of the respective first pivot axis to an opposing lateral side as the said at least one part rotates about the respective second pivot axis from its operative position to the intervening position.

12. A pile guide according to claim 7, further comprising a mechanism for restoring parts of the pile guide member to the operative position from the inoperative position.

13. A pile guide according to claim 12, in which the mechanism is configured to drive movement of the parts of the pile guide member from the inoperative position to the operative position only.

14. A pile guide according to claim 12, in which the mechanism comprises a variable length strut or piston pivotally coupled between the base frame and the support member of one part for rotating that support member about its first pivot axis.

15. A pile guide according to claim 12, in which the mechanism comprises a variable length strut or piston pivotally coupled between one part and its support member for rotating that one part about its second pivot axis.

16. A pile guide according to claim 7, wherein each support member is mounted on the base frame via a mounting arrangement configured to vary displacement and/or orientation of each respective first pivot axis relative to a substrate-engaging surface of the base frame.

17. A pile guide according to claim 16, wherein at least one mounting arrangement may comprise a pair of couplings spaced along the respective first pivot axis, with at least one of the pair of couplings being displaceable relative to the substrate-engaging surface of the base frame in a direction perpendicular thereto.

18. A pile guide for supporting a pile as it is driven into a substrate, comprising:

a base frame; and a pile guide member which is mounted on the base frame and defines a passageway with a substantially cylindrical inner peripheral surface to which a plurality of elongate members are attached, the plurality of elongate members being aligned parallel to a longitudinal axis of the substantially cylindrical inner peripheral surface and circumferentially spaced around the inner peripheral surface and configured to engage a pile and guide it in a predetermined direction through the passageway as it is driven into a substrate, wherein at least one elongate member and the inner peripheral surface of the passageway have releasable inter-connecting profiles for releasably attaching the at least one elongate member to the inner peripheral surface.

19. A pile guide according to claim 18, wherein the at least one elongate member has a tapered leading end to assist with aligning a pile with the passageway as the pile is introduced into the pile guide member.

* * * * *